US010816295B1

(12) United States Patent
Oglesby

(10) Patent No.: US 10,816,295 B1
(45) Date of Patent: Oct. 27, 2020

(54) ENHANCED BOLT CATCH

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 16/787,851

(22) Filed: Feb. 11, 2020

Related U.S. Application Data

(60) Provisional application No. 62/806,799, filed on Feb. 16, 2019.

(51) Int. Cl.
*F41A 17/36* (2006.01)
*F41A 3/72* (2006.01)

(52) U.S. Cl.
CPC ..... *F41A 17/36* (2013.01); *F41A 3/72* (2013.01)

(58) Field of Classification Search
CPC ..... F41A 17/36; F41A 17/40; F41A 17/38; F41A 3/72
See application file for complete search history.

(56) References Cited

U.S. PATENT DOCUMENTS 10,234,226 B1 * 3/2019 Copeland ..... F41A 17/38
2012/0167424 A1 * 7/2012 Gomez ..... F41A 35/06 42/14
2017/0284761 A1 * 10/2017 Lewis ..... F41A 17/36
2019/0093978 A1 * 3/2019 Maugham ..... F41A 17/36
2020/0182571 A1 * 6/2020 Noonan ..... F41A 3/66

FOREIGN PATENT DOCUMENTS

CA 2962313 A1 * 9/2017 ..... F41A 3/72

* cited by examiner

*Primary Examiner* — Stephen Johnson

(74) *Attorney, Agent, or Firm* — Shaddock Law Group, PC

(57) ABSTRACT

A bolt catch to be utilized in conjunction with an upper receiver and the lower receiver of a firearm, including at least some of a bolt catch having a bolt catch upper button portion and a bolt catch lower button portion, wherein the bolt catch is pivotally attached or coupled within at least a portion of a lower bolt catch recess of a lower receiver, wherein at least a portion of a bolt catch upper button portion recess extends above a planar surface formed by the lower receiver proximate the lower bolt catch recess; and an upper bolt catch recess formed in at least a portion of the upper receiver, wherein at least a portion of the bolt catch upper button portion recess is received at least partially within the upper bolt catch recess if the upper receiver is operably attached or coupled to the lower receiver.

20 Claims, 16 Drawing Sheets

ENHANCED BOLT CATCH

CROSS-REFERENCE TO RELATED APPLICATIONS

This patent application claims the benefit of U.S. Patent Application Ser. No. 62/806,799, filed Feb. 16, 2019, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an enhanced bolt catch for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms, include a pushbutton magazine release found on one side of the firearm—typically the right side. Oftentimes, the magazine release button is at least partially protected by one or more ridges that reduce the chances of inadvertent activation.

The magazine release button is typically attached or coupled to a magazine release, which includes a magazine engagement projection that releasably engages a portion of a magazine, when the magazine is fully inserted within the magazine well of the firearm.

The magazine release includes a magazine release connection shaft that extends from one side of the magazine release. The magazine release connection shaft includes a threaded portion that can be threaded late engaged with the threaded aperture of the magazine release button.

A magazine release spring typically provides spring biasing to the magazine release lever, when installed in the firearm.

The bolt catch is typically pivotably attached or coupled to the lower receiver on a left side, opposite the magazine release button. The bolt catch includes a bolt catch upper button portion and a bolt catch lower button portion, each of which can be pressed to pivot the bolt catch about a bolt catch pivot pin aperture to pivot the bolt catch from a bolt engagement position to a bolt disengagement position. The bolt catch is typically spring biased to the bolt disengagement position.

In the bolt engagement position, the bolt catch is pivoted such that at least a portion of a bolt engagement projection extends in front of the face of the bolt carrier (when the bolt carrier is in a rearward position) and engages the bolt face to maintain the ball carrier in the rearward position.

A magazine biasing projection extends from the bolt catch so as to interact with a follower in a magazine. In this manner, when an empty magazine is in the firearm, the magazine follower interacts with the magazine biasing projection, to pivot the bolt catch to a bolt engagement position.

When the bolt catch upper button portion is depressed, the bolt catch pivots such that the bolt engagement projection is urged downward, away from the face of the bolt carrier, allowing the bolt carrier to move forward.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the original and current bolt catch designs suffer from a design that allows it to be snagged on clothing, webbing and other support equipment in dynamic kinetic situations. Traditionally, bolt catches are machined from investment cast 8620 steel and then case hardened for durability. The lack of grain structure to the investment casting and relatively thin wall structure around the bolt catch pivot pin aperture area can cause breakage when the bolt catch is put under stress, as may be induced from operation or interference with clothing and equipment.

In addition, the support lugs found on the lower receiver may also fail due to stress induced by the bolt catch and bolt catch pivot pin.

An improvement to the current design is therefore required to improve reliability and functionality.

These and other disadvantages and shortcomings of the prior art are overcome by the features and elements of the enhanced bolt catch of the present disclosure. In various exemplary, nonlimiting embodiments, an enhanced bolt catch and an associated receiver and/or lower receiver are provided to accommodate the enhancements of the bolt catch.

In various exemplary, nonlimiting embodiments, the bolt catch of the present disclosure includes additional material added around the bolt catch pivot pin aperture. If the additional material were to be added to a known bolt catch, the bolt catch would not fit within the area provided between a known upper receiver and lower receiver.

The bolt catch recess of a known lower receiver would not allow the bolt catch of the present disclosure to pivot in relation to the lower receiver. The lower receiver's bolt catch plunger recess has therefore been moved inwards slightly to accommodate the larger part and allow the plunger and spring to still work against the bolt catch and allow the bolt catch to rotate to the same degree as the standard version. This has an added benefit of reducing a small amount of weight to the lower receiver.

In various exemplary, nonlimiting embodiments, the bolt catch upper button portion is enlarged and includes a chamfered bolt catch button edge portion that corresponds at least partially to a ridge or ridge segment of the upper receiver so that the surface flow continues smoothly from the bolt catch edge portion of the bolt catch upper button portion to the ridge or ridge segment of the upper receiver.

In order to accommodate the extra material added to the bolt catch, an upper bolt catch recess is formed in at least a portion of the upper receiver to accommodate the extra material added to the bolt catch button portion recess. The retaining lugs for the bolt catch have also been enlarged on the lower receiver to increase some strength in this area.

The advantages of the present disclosure are optionally attained by providing, in an exemplary, nonlimiting embodiment, an enhanced bolt catch. In various exemplary, nonlimiting embodiments, the bolt catch is to be utilized in conjunction with an upper receiver and the lower receiver of a firearm and includes at least some of a bolt catch having a bolt catch upper button portion and a bolt catch lower button portion, wherein the bolt catch is pivotally attached or coupled within at least a portion of a lower bolt catch recess of the lower receiver, approximately between the bolt catch upper button portion and the bolt catch lower button portion, wherein at least a portion of a bolt catch upper button portion recess extends above a planar surface formed by the lower receiver proximate the lower bolt catch recess; and an upper bolt catch recess formed in at least a portion of the upper receiver, wherein at least a portion of the bolt catch upper button portion recess is received at least partially within the upper bolt catch recess if the upper receiver is operably attached or coupled to the lower receiver.

In various exemplary, nonlimiting embodiments, a first side of the bolt catch upper button portion includes a textured portion.

In various exemplary, nonlimiting embodiments, a first side of the bolt catch lower button portion includes a textured portion.

In various exemplary, nonlimiting embodiments, the bolt catch upper button portion recess is formed between the bolt catch upper button portion and a bolt engagement projection.

In various exemplary, nonlimiting embodiments, the bolt catch upper button portion recess is formed between the bolt catch upper button portion and a magazine biasing projection.

In various exemplary, nonlimiting embodiments, the bolt catch is pivotable between a bolt engagement position to a bolt disengagement position.

In various exemplary, nonlimiting embodiments, a bolt catch pivot pin aperture is formed through the bolt catch, approximately between the bolt catch upper button portion and the bolt catch lower button portion.

In various exemplary, nonlimiting embodiments, the upper bolt catch recess extends from a lower surface of the upper receiver.

In various exemplary, nonlimiting embodiments, if the upper receiver is operably attached or coupled to the lower receiver, the upper bolt catch recess is positioned above the lower bolt catch recess.

In various exemplary, nonlimiting embodiments, a ridge is formed so as to extend from at least a portion of the upper receiver around at least a portion of an area where the bolt catch upper button portion of the bolt catch overlies the upper receiver, when the bolt catch is installed within the lower receiver and the upper receiver is operably attached or coupled to the lower receiver.

In various exemplary, nonlimiting embodiments, the ridge is a single, continuous ridge.

In various exemplary, nonlimiting embodiments, the ridge is defined by one or more ridge portions are segments.

In various exemplary, nonlimiting embodiments, the ridge provides a perimeter around at least a portion of the bolt catch.

In various exemplary, nonlimiting embodiments, the bolt catch upper button portion includes a chamfered bolt catch button edge portion.

In various exemplary, nonlimiting embodiments, an angle or degree of chamfer of the chamfered bolt catch button edge portion is such that there is a substantially smooth transition between the chamfered bolt catch button portion and an adjacent portion of the ridge.

In various exemplary, nonlimiting embodiments, the bolt catch is to be utilized in conjunction with an upper receiver and the lower receiver of a firearm and includes at least some of a bolt catch having a bolt catch upper button portion and a bolt catch lower button portion, wherein the bolt catch is pivotally positionable within at least a portion of a lower bolt catch recess of the lower receiver, wherein a bolt catch upper button portion recess is formed between the bolt catch upper button portion and a bolt engagement projection, and wherein at least a portion of the bolt catch upper button portion recess extends above a planar surface formed by the lower receiver proximate the lower bolt catch recess; and an upper bolt catch recess formed in at least a portion of the upper receiver, wherein at least a portion of the bolt catch upper button portion recess is received at least partially within the upper bolt catch recess if the upper receiver is operably attached or coupled to the lower receiver.

In various exemplary, nonlimiting embodiments, the bolt catch is pivotable between a bolt engagement position to a bolt disengagement position.

In various exemplary, nonlimiting embodiments, the upper bolt catch recess extends from a lower surface of the upper receiver.

In various exemplary, nonlimiting embodiments, if the upper receiver is operably attached or coupled to the lower receiver, the upper bolt catch recess is positioned above the lower bolt catch recess.

In various exemplary, nonlimiting embodiments, the bolt catch is to be utilized in conjunction with an upper receiver and the lower receiver of a firearm and includes at least some of a bolt catch having a bolt catch upper button portion and a bolt catch lower button portion, wherein the bolt catch is pivotally positionable within at least a portion of a lower bolt catch recess of the lower receiver, wherein a bolt catch upper button portion recess is formed between the bolt catch upper button portion and a magazine biasing projection, and wherein at least a portion of the bolt catch upper button portion recess extends above a planar surface formed by the lower receiver proximate the lower bolt catch recess; and an upper bolt catch recess formed in at least a portion of the upper receiver, wherein at least a portion of the bolt catch upper button portion recess is received at least partially within the upper bolt catch recess if the upper receiver is operably attached or coupled to the lower receiver.

Accordingly, the presently disclosed systems, methods, and/or apparatuses provide an enhanced bolt catch that provides additional material around the bolt catch pivot pin aperture to further strengthen the bolt catch.

The presently disclosed systems, methods, and/or apparatuses optionally and separately provide an enhanced bolt catch that include an upper bolt catch recess formed in at least a portion of the upper receiver to accommodate the extra material added to the bolt catch button portion recess.

The presently disclosed systems, methods, and/or apparatuses optionally and separately provide an enhanced bolt catch that includes a chamfered bolt catch button edge portion that corresponds at least partially to a ridge or ridge segment of the upper receiver so that the surface flow continues smoothly from the bolt catch edge portion of the bolt catch upper button portion to the ridge or ridge segment of the upper receiver.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

For simplicity and clarification, the design factors and operating principles of the enhanced bolt catch according to the presently disclosed systems, methods, and/or apparatuses are explained with reference to various exemplary embodiments of an enhanced bolt catch according to the presently disclosed systems, methods, and/or apparatuses. The basic explanation of the design factors and operating principles of the enhanced bolt catch is applicable for the understanding, design, and operation of the enhanced bolt catch of the presently disclosed systems, methods, and/or apparatuses. It should be appreciated that the enhanced bolt catch can be adapted to many applications where gas pressure or blowback is experienced within a firearm.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "firearm", "upper receiver", "lower receiver", and "bolt catch" are used for basic explanation and understanding of the operation of the systems, methods, and apparatuses of this invention. Therefore, the terms "firearm", "upper receiver", "lower receiver", and "bolt catch" are not to be construed as limiting the systems, methods, and apparatuses of this invention. Thus, for example, the term "firearm" is to be understood to broadly include any firearm utilizing a bolt catch or bolt release.

Figure 1:
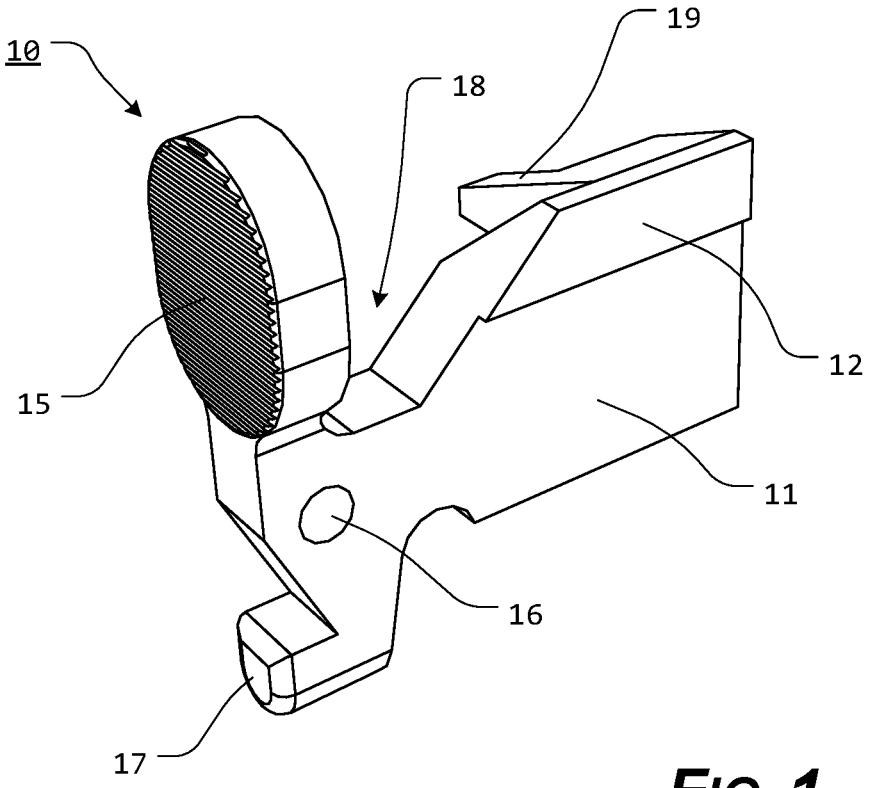
FIG. 1 PRIOR ART
FIG. 1 illustrates a perspective view of a known AR-15 style bolt catch.
Figure 2:
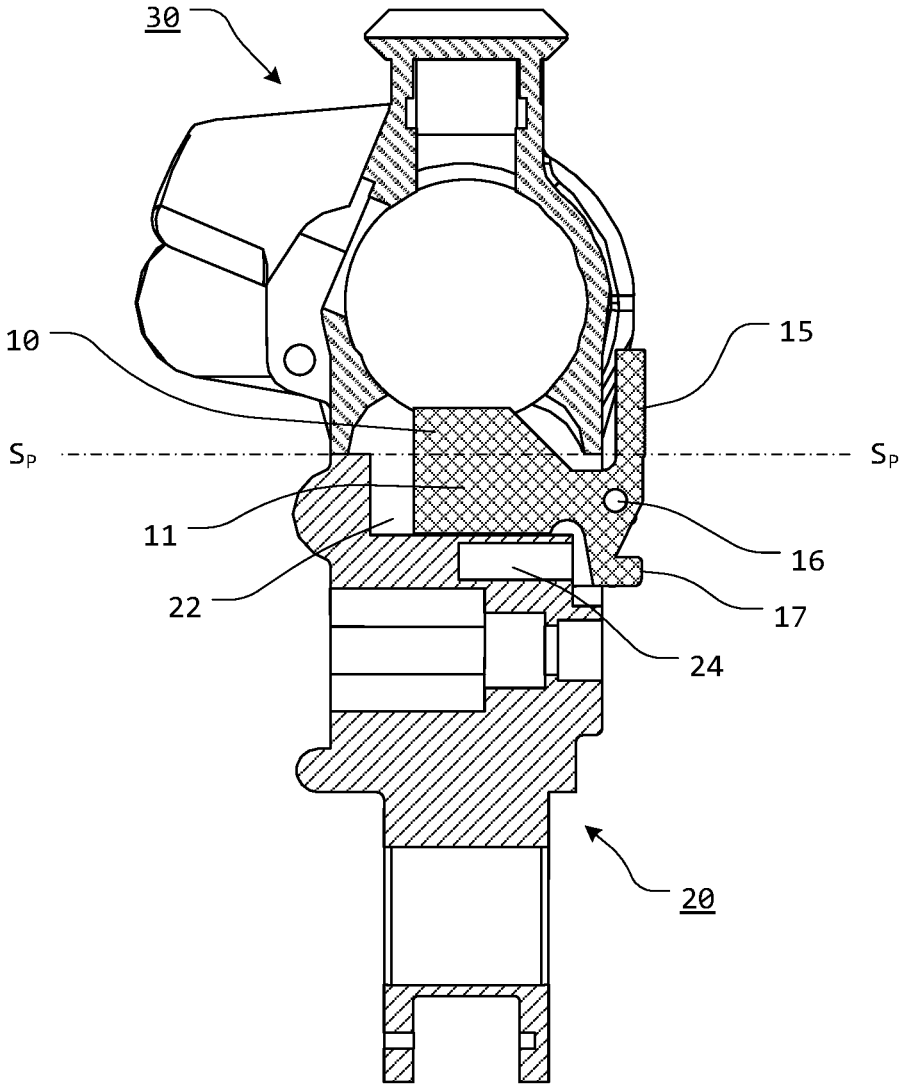
FIG. 2 PRIOR ART
FIG. 2 illustrates a front cutaway view of a portion of a known AR-15 style upper and lower receiver having a known bolt catch installed therein.
Figure 3:
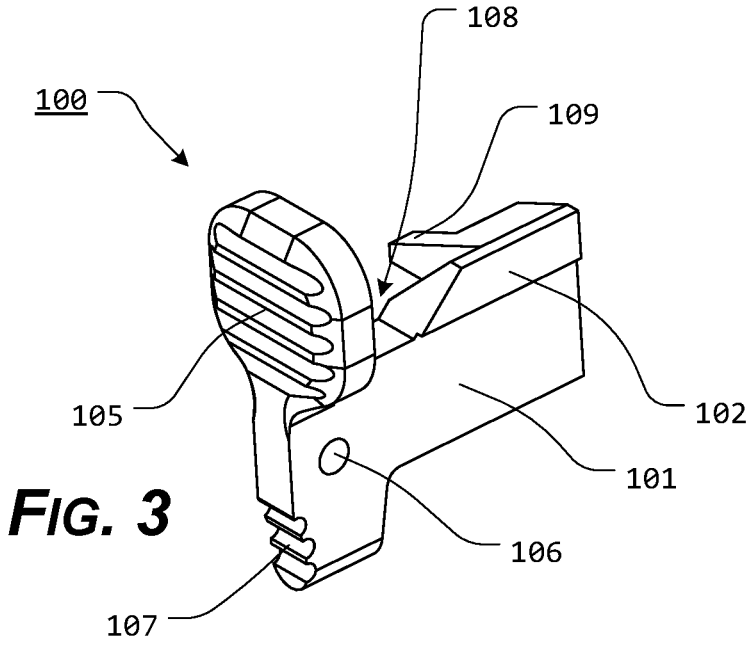
FIG. 3 illustrates a front perspective view of an exemplary embodiment of an enhanced bolt catch, according to the presently disclosed systems, methods, and/or apparatuses.
Figure 4:
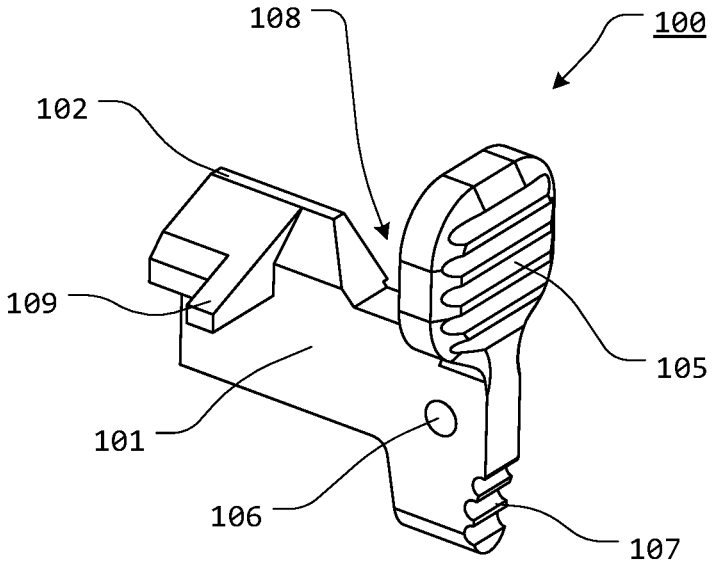
FIG. 4 illustrates a front perspective view of an exemplary embodiment of an enhanced bolt catch, according to the presently disclosed systems, methods, and/or apparatuses.
Figure 5:
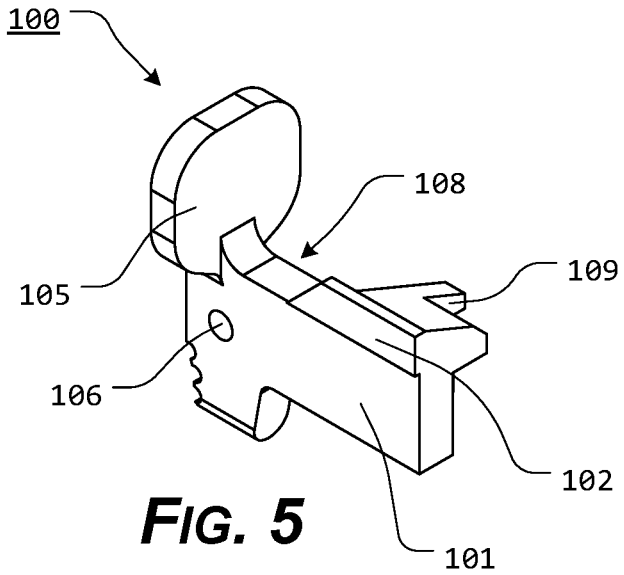
FIG. 5 illustrates a rear perspective view of an exemplary embodiment of an enhanced bolt catch, according to the presently disclosed systems, methods, and/or apparatuses.
Figure 6:
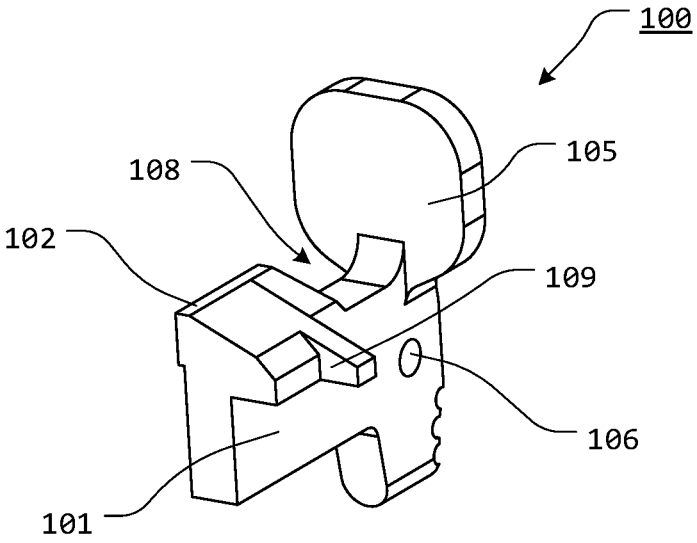
FIG. 6 illustrates a rear perspective view of an exemplary embodiment of an enhanced bolt catch, according to the presently disclosed systems, methods, and/or apparatuses.
Figure 7:
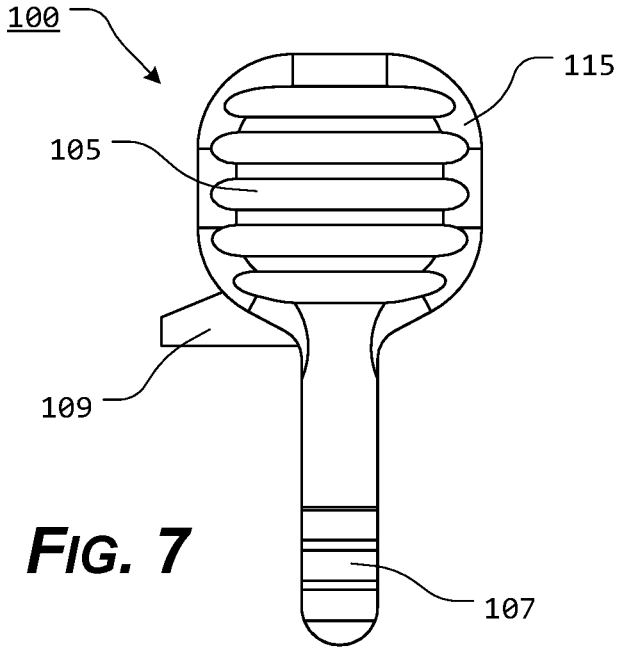
FIG. 7 illustrates a front view of an exemplary embodiment of an enhanced bolt catch, according to the presently disclosed systems, methods, and/or apparatuses.
Figure 8:
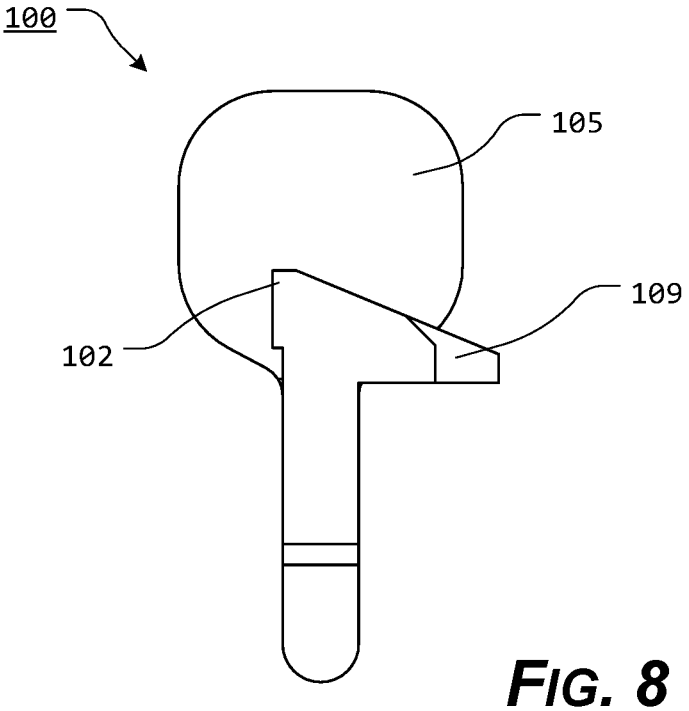
FIG. 8 illustrates a rear view of an exemplary embodiment of an enhanced bolt catch, according to the presently disclosed systems, methods, and/or apparatuses.
Figure 9:
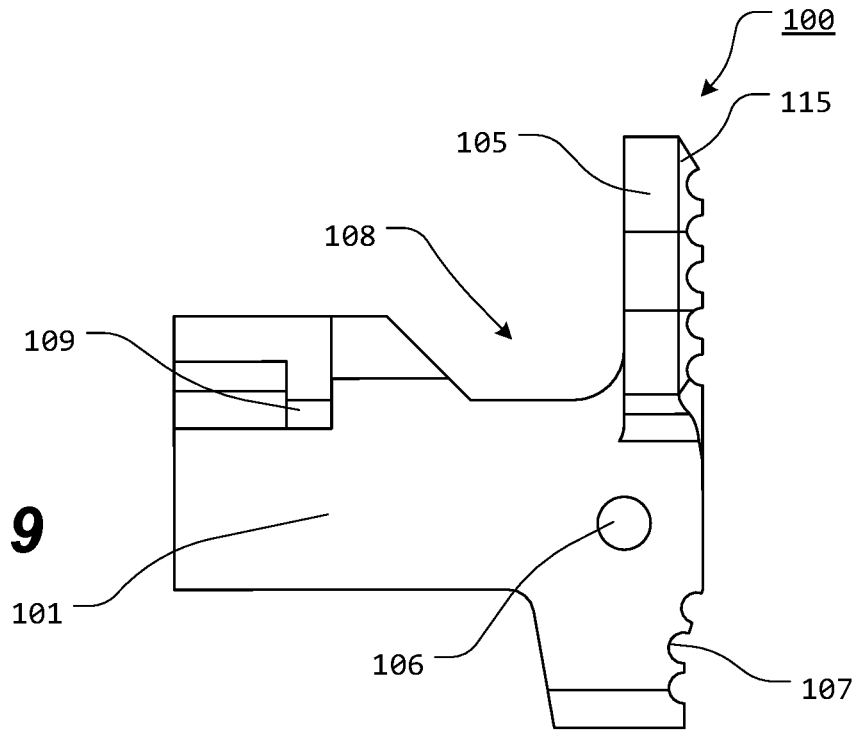
FIG. 9 illustrates a left side view of an exemplary embodiment of an enhanced bolt catch, according to the presently disclosed systems, methods, and/or apparatuses.
Figure 10:
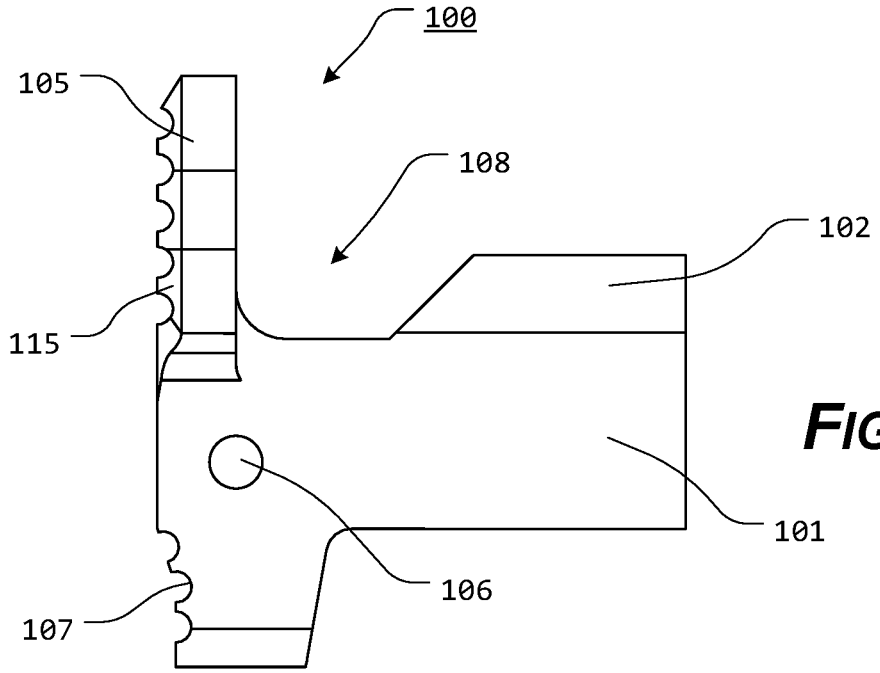
FIG. 10 illustrates a right side view of an exemplary embodiment of an enhanced bolt catch, according to the presently disclosed systems, methods, and/or apparatuses.
Figure 11:
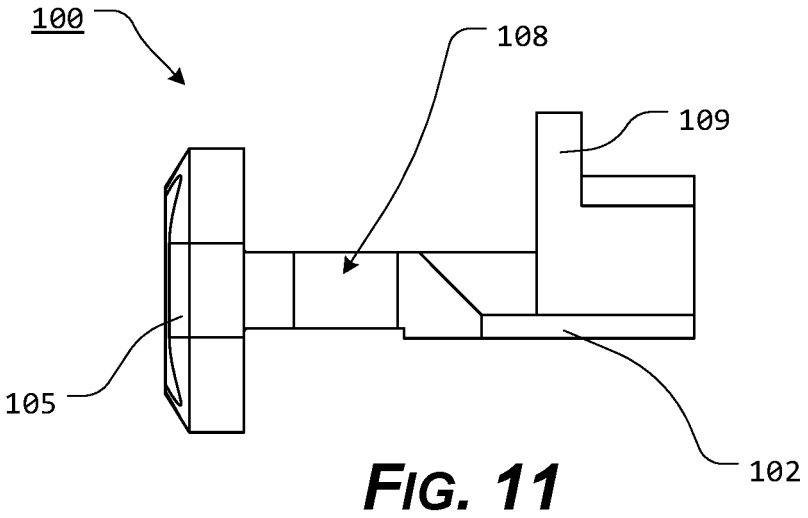
FIG. 11 illustrates a top view of an exemplary embodiment of an enhanced bolt catch, according to the presently disclosed systems, methods, and/or apparatuses.
Figure 12:
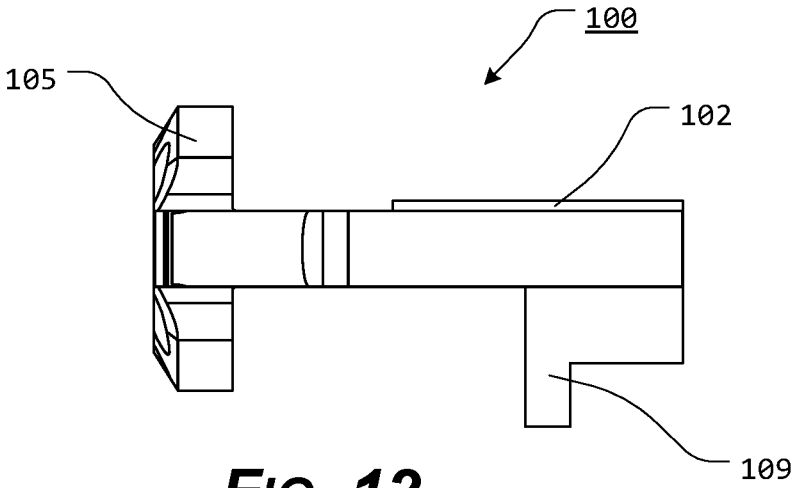
FIG. 12 illustrates a bottom view of an exemplary embodiment of an enhanced bolt catch, according to the presently disclosed systems, methods, and/or apparatuses.
Figure 13:
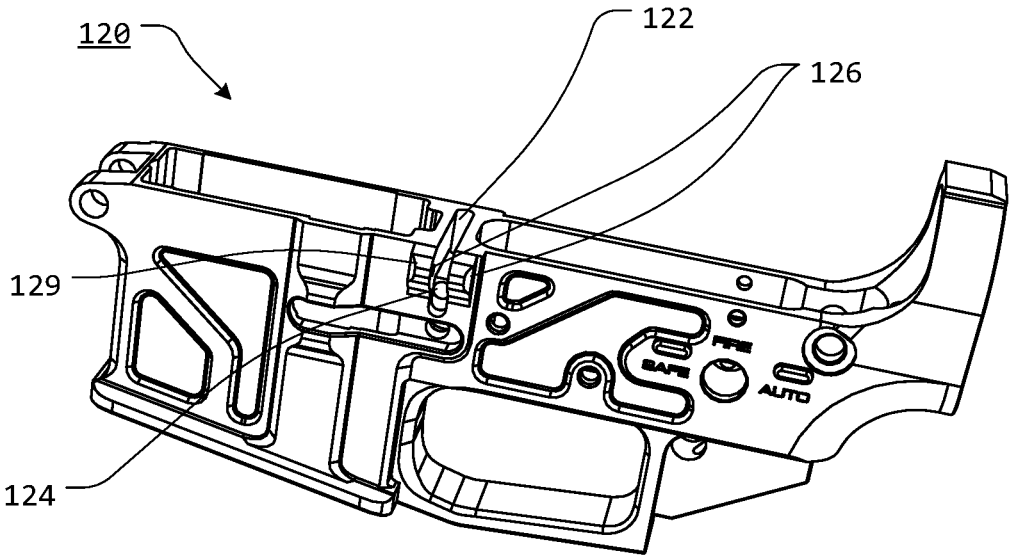
FIG. 13 illustrates a perspective view of an exemplary embodiment of a lower receiver to be utilized in conjunction with an enhanced bolt catch, according to the presently disclosed systems, methods, and/or apparatuses.
Figure 14:
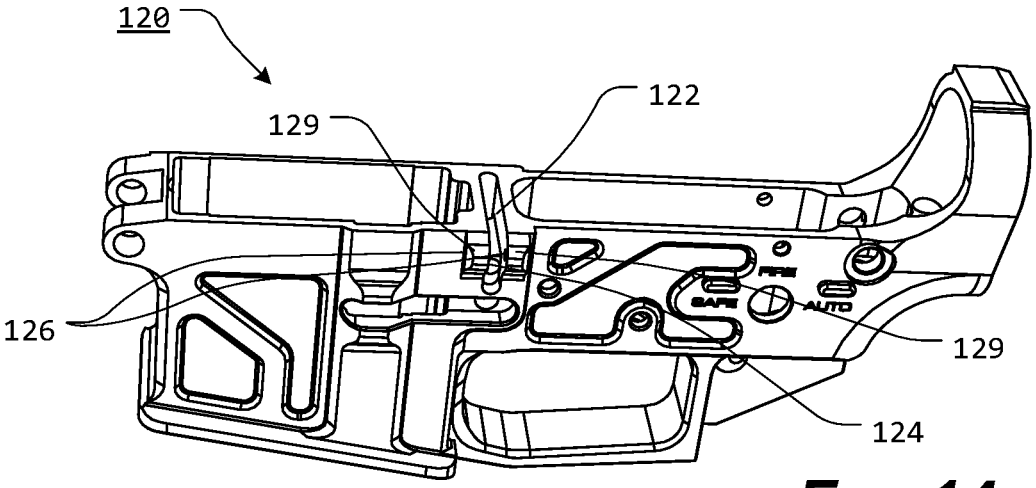
FIG. 14 illustrates a perspective view of an exemplary embodiment of a lower receiver to be utilized in conjunction with an enhanced bolt catch, according to the presently disclosed systems, methods, and/or apparatuses.
Figure 15:
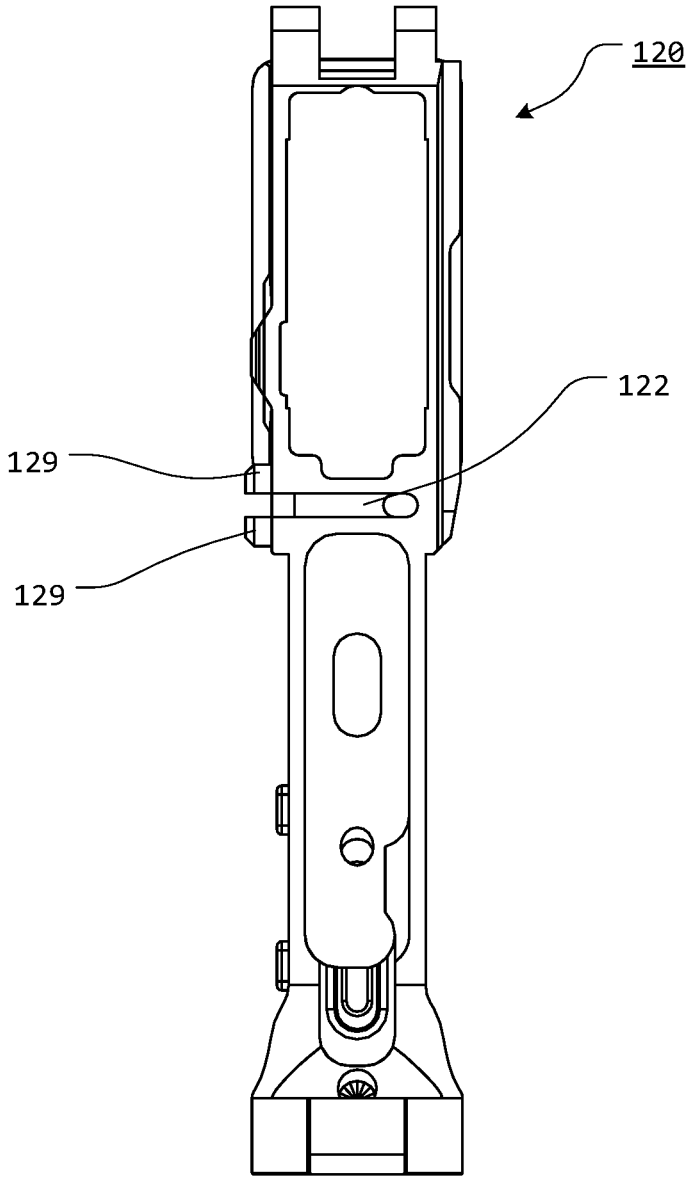
FIG. 15 illustrates a top view of an exemplary embodiment of a lower receiver to be utilized in conjunction with an enhanced bolt catch, according to the presently disclosed systems, methods, and/or apparatuses.
Figure 16:
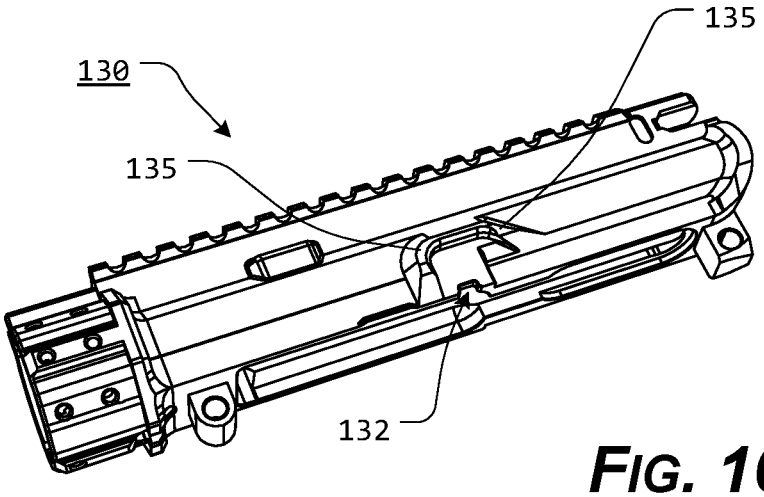
FIG. 16 illustrates a perspective view of an exemplary embodiment of an upper receiver to be utilized in conjunction with an enhanced bolt catch, according to the presently disclosed systems, methods, and/or apparatuses.
Figure 17:
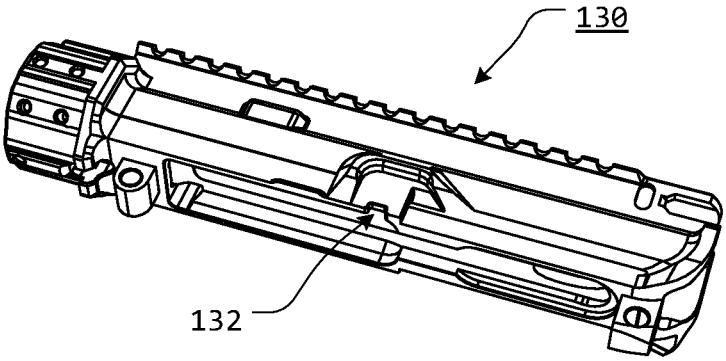
FIG. 17 illustrates a perspective view of an exemplary embodiment of an upper receiver to be utilized in conjunction with an enhanced bolt catch, according to the presently disclosed systems, methods, and/or apparatuses.
Figure 18:
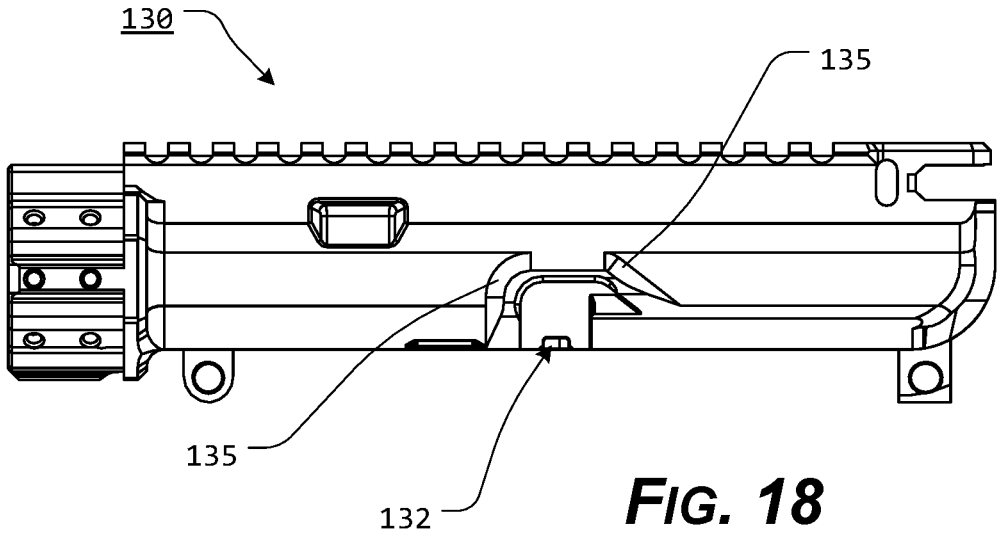
FIG. 18 illustrates a left side view of an exemplary embodiment of an upper receiver to be utilized in conjunction with an enhanced bolt catch, according to the presently disclosed systems, methods, and/or apparatuses.
Figure 19:
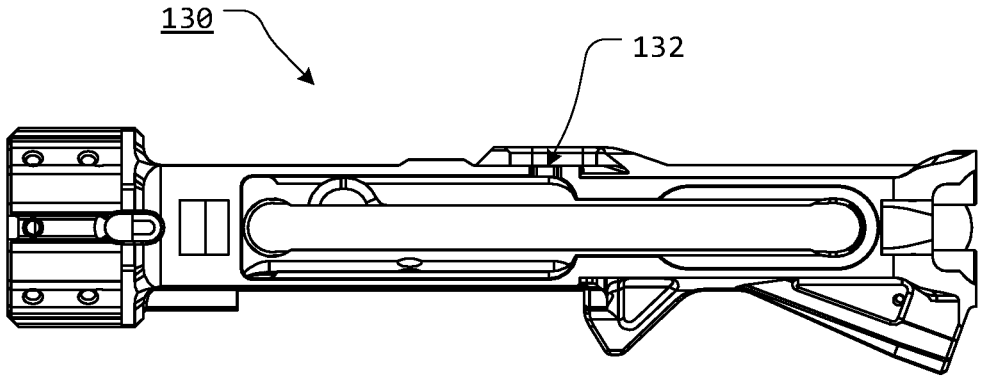
FIG. 19 illustrates a bottom view of an exemplary embodiment of an upper receiver to be utilized in conjunction with an enhanced bolt catch, according to the presently disclosed systems, methods, and/or apparatuses.
Figure 20:
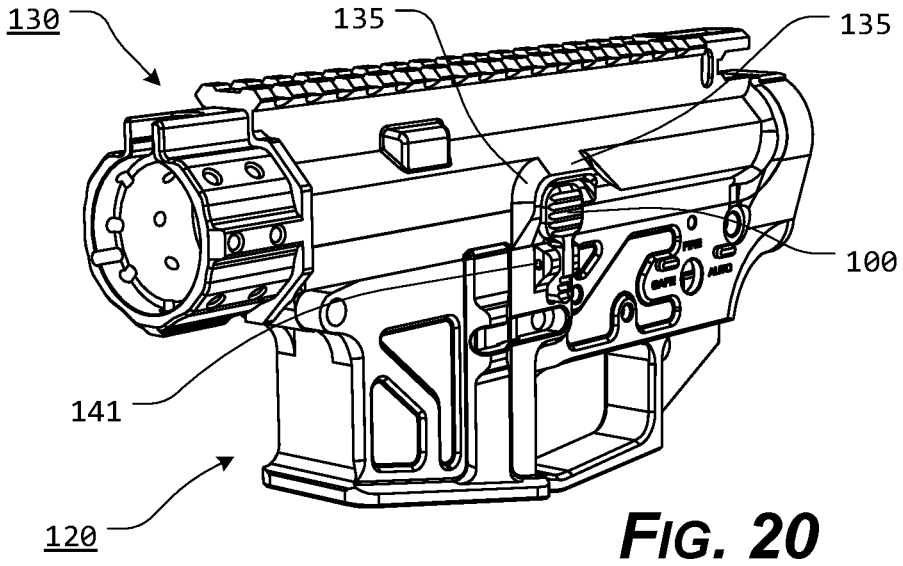
FIG. 20 illustrates a front perspective view of an exemplary embodiment of an upper receiver and a lower receiver, utilized in conjunction with an enhanced bolt catch, according to the presently disclosed systems, methods, and/or apparatuses.
Figure 21:
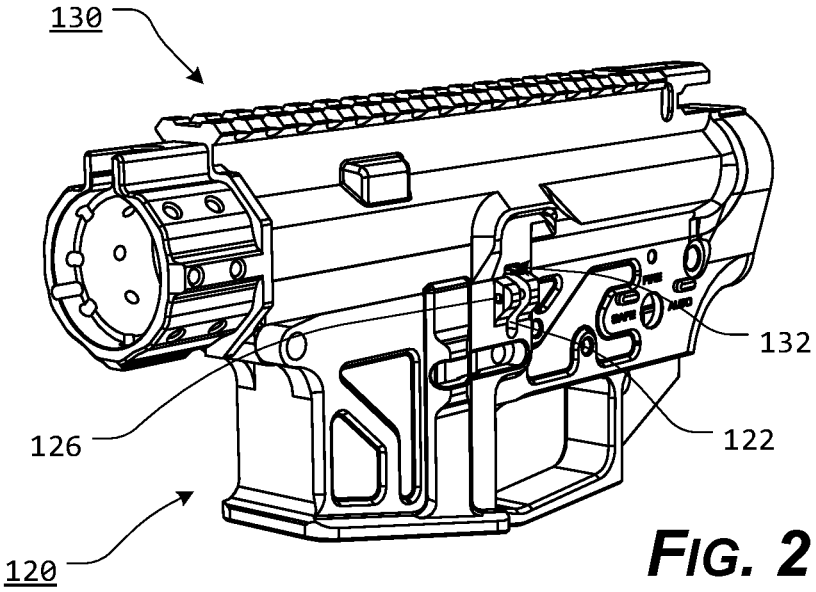
FIG. 21 illustrates a front perspective view of an exemplary embodiment of an upper receiver and a lower receiver to be utilized in conjunction with an enhanced bolt catch, according to the presently disclosed systems, methods, and/or apparatuses.
Figure 22:
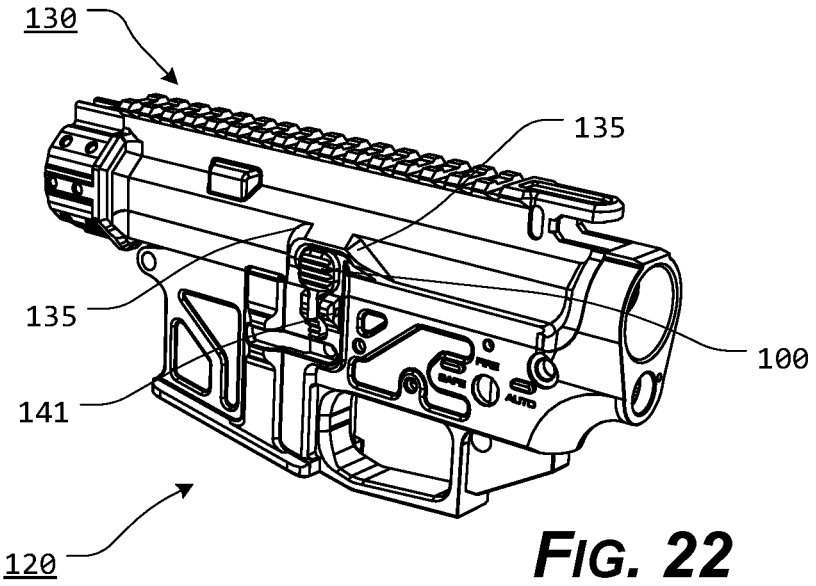
FIG. 22 illustrates a rear perspective view of an exemplary embodiment of an upper receiver and a lower receiver, utilized in conjunction with an enhanced bolt catch, according to the presently disclosed systems, methods, and/or apparatuses.
Figure 23:
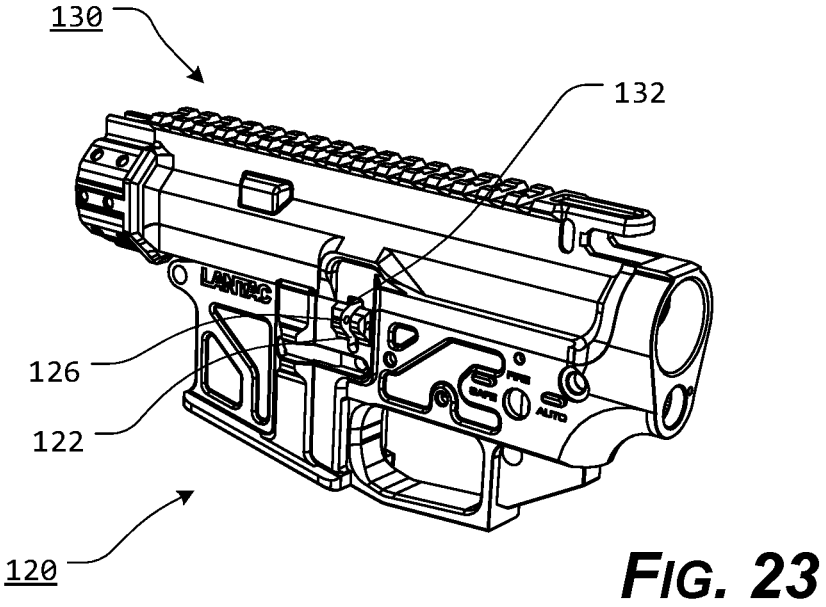
FIG. 23 illustrates a rear perspective view of an exemplary embodiment of an upper receiver and a lower receiver to be utilized in conjunction with an enhanced bolt catch, according to the presently disclosed systems, methods, and/or apparatuses.
Figure 24:
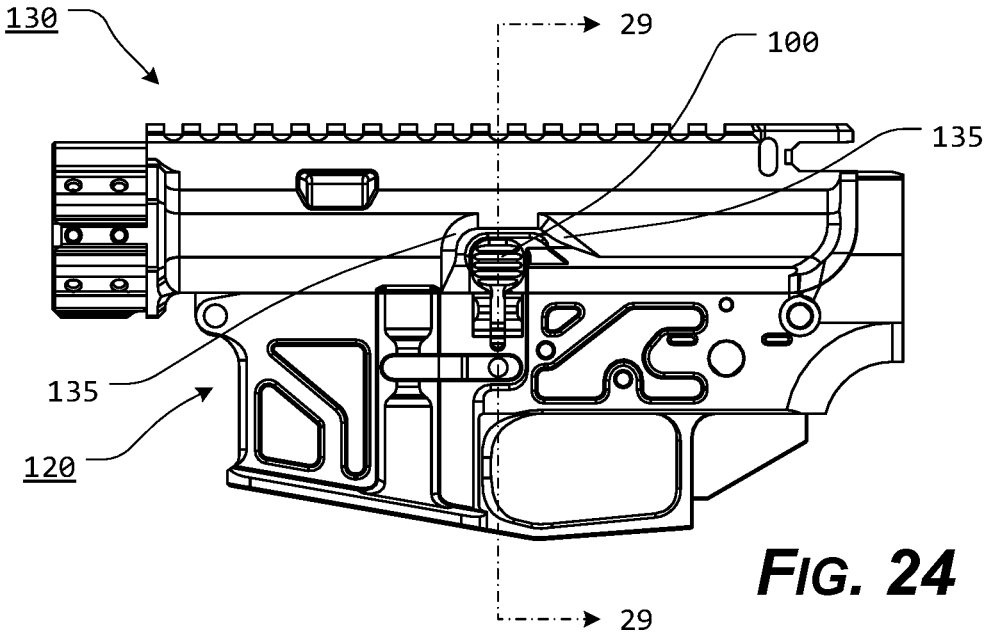
FIG. 24 illustrates a left side view of an exemplary embodiment of an upper receiver and a lower receiver, utilized in conjunction with an enhanced bolt catch, according to the presently disclosed systems, methods, and/or apparatuses.
Figure 25:
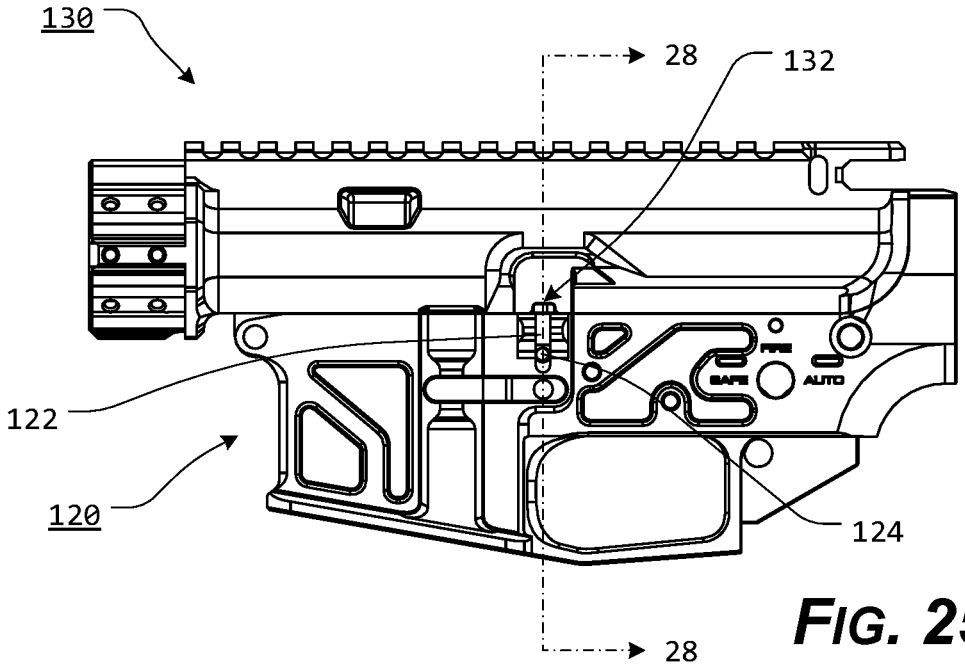
FIG. 25 illustrates a left side view of an exemplary embodiment of an upper receiver and a lower receiver to be utilized in conjunction with an enhanced bolt catch, according to the presently disclosed systems, methods, and/or apparatuses.
Figure 26:
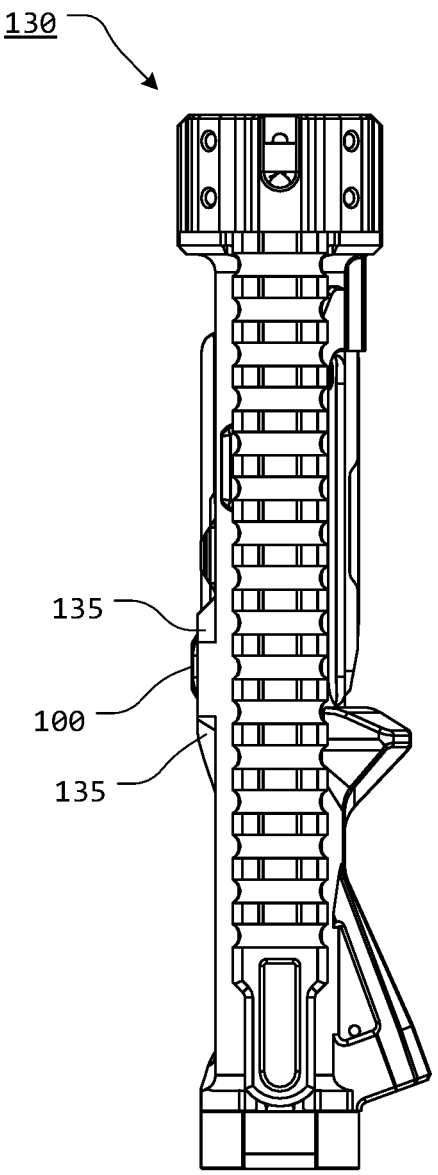
FIG. 26 illustrates a top view of an exemplary embodiment of an upper receiver and a lower receiver, utilized in conjunction with an enhanced bolt catch, according to the presently disclosed systems, methods, and/or apparatuses.
Figure 27:
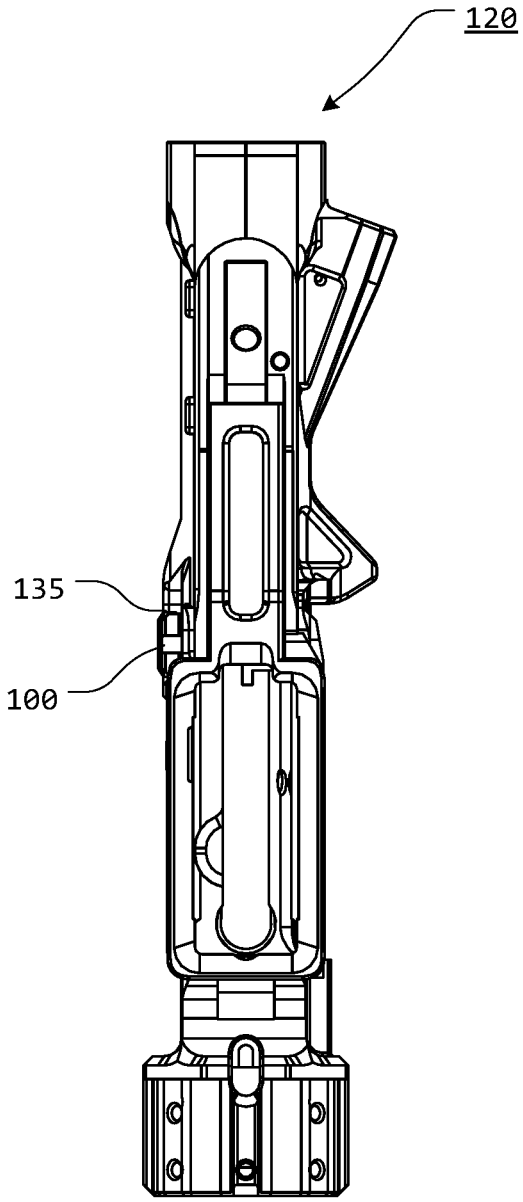
FIG. 27 illustrates a bottom view of an exemplary embodiment of an upper receiver and a lower receiver, utilized in conjunction with an enhanced bolt catch, according to the presently disclosed systems, methods, and/or apparatuses.
Figure 28:
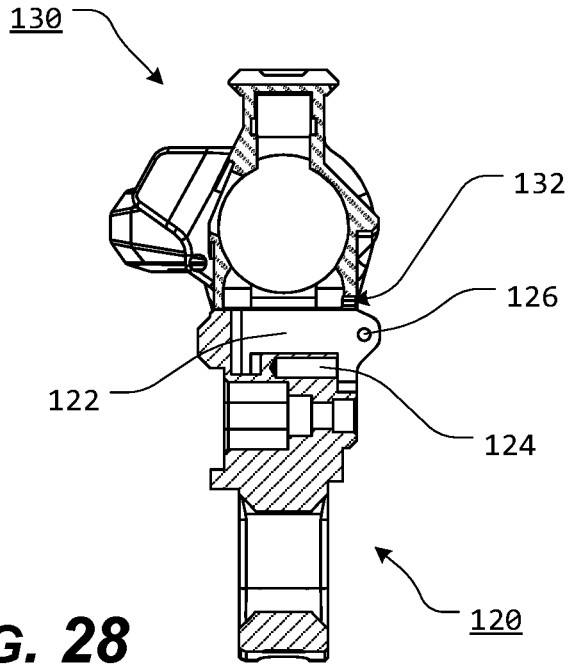
FIG. 28 illustrates a front, cross-sectional view, taken along line 28-28 of FIG. 25, of an exemplary embodiment of an upper receiver and a lower receiver to be utilized in conjunction with an enhanced bolt catch, according to the presently disclosed systems, methods, and/or apparatuses.
Figure 29:
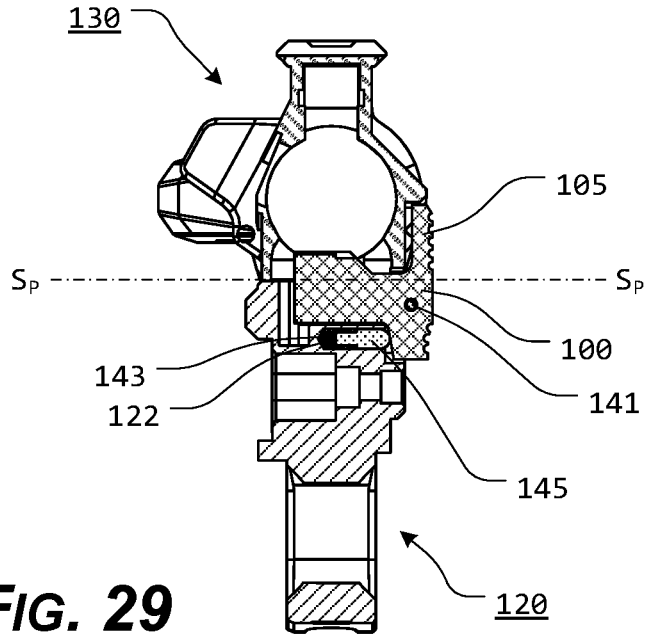
FIG. 29 illustrates a front, cross-sectional view, taken along line 29-29 of FIG. 24, of an exemplary embodiment of an upper receiver and a lower receiver, utilized in conjunction with an enhanced bolt catch, according to the presently disclosed systems, methods, and/or apparatuses.

Turning now to the drawing FIGS., FIGS. 1 and 2 illustrate certain elements and/or aspects of a known, exemplary AR-15 style bolt catch 10. Generally, the bolt catch 10 comprises at least some of a bolt catch body portion 11, a bolt catch upper button portion 15, a bolt catch lower button portion 17, a bolt engagement projection 12, a magazine biasing projection 19, and a bolt catch pivot pin aperture 16.

When installed in a bolt catch recess 22 of a lower receiver 20, as illustrated in FIG. 2, the bolt catch 10 is pivotable, relative to the lower receiver 20, via a bolt catch 10 pivot pin positioned through the bolt catch pivot pin aperture 16. The bolt catch 10 is pivotably attached or coupled to the lower receiver 20 on a left side, opposite the magazine release button. The bolt catch upper button portion 15 or the bolt catch lower button portion 17 can be pressed to pivot the bolt catch 10 about a bolt catch pivot pin aperture 16 to pivot the bolt catch 10 from a bolt engagement position to a bolt disengagement position.

The bolt catch 10 is typically spring biased to the bolt disengagement position, via a bolt catch plunger and a bolt catch plunger spring positioned within the bolt catch plunger recess 24.

In the bolt engagement position, the bolt catch 10 is pivoted such that at least a portion of a bolt engagement projection 12 extends in front of a portion of the face of the bolt carrier (when the bolt carrier is in a rearward position) and is able to engage a portion of the bolt face to maintain the bolt carrier in the rearward position. In the bolt disengagement position, the bolt catch 10 is pivoted such that the bolt engagement projection 12 will not engage the face of the bolt carrier and the bolt engagement projection 12 will not engage the bolt carrier.

The magazine biasing projection 19 extends from the bolt catch 10 so as to interact with a follower in a magazine. In this manner, when an empty magazine is in the firearm, the magazine follower interacts with the magazine biasing projection 19, to pivot the bolt catch 10 to a bolt engagement position.

When the bolt catch upper button portion 15 is depressed, the bolt catch 10 pivots such that the bolt engagement projection 12 is urged downward, away from the face of the bolt carrier, allowing the bolt carrier to move forward. When the bolt catch lower button portion 17 is depressed, the bolt catch 10 pivots such that the bolt engagement projection 12 is urged upward, towards the face of the bolt carrier, allowing the bolt carrier to move forward.

A planar portion of the lower surface of the upper receiver 30 is positioned above the bolt catch upper button portion recess 18. A bolt catch upper button portion recess 18 formed between the bolt catch upper button portion 15 and the bolt engagement projection 12 allows the bolt catch 10 to continue to pivot to a bolt engagement position when the upper receiver 30 and the lower receiver 20 are in an operable configuration.

As illustrated in FIGS. 3-29, the bolt catch 100 of the present disclosure comprises at least some of a bolt catch body portion 101, a bolt catch upper button portion 105, a bolt catch lower button portion 107, a bolt engagement projection 102, a magazine biasing projection 109, and a bolt catch pivot pin aperture 106.

The bolt catch upper button portion 105 includes a first side facing generally outward, away from the bolt engagement projection 102 and the magazine biasing projection 109, and a second side facing toward the bolt engagement projection 102 and the magazine biasing projection 109. The bolt catch body portion 101 comprises at least some of a bolt catch upper button portion 105 and a bolt catch lower button portion 107.

In various exemplary embodiments, the first side of the bolt catch upper button portion 105 includes a textured portion. In various exemplary embodiments, the first side of the bolt catch lower button portion 107 includes a textured portion (not shown). In this manner, the bolt catch upper button portion 105 and/or the bolt catch lower button portion 107 may be distinguished tactilely from other portions of the bolt catch 100.

In various exemplary, non-limiting embodiments, bolt catch 100 is pivotally connected to the lower receiver 120, between the bolt catch upper button portion 105 and the bolt catch lower button portion 107, via a fulcrum or bolt catch pivot pin 141 positioned through the lower receiver bolt catch pivot pin apertures 126 and the bolt catch pivot pin aperture 106. The lower receiver bolt catch pivot pin apertures 126 are formed through the retaining lugs 129 of the lower receiver 120.

Generally, a portion of the bolt catch 100 is positioned within the lower bolt catch recess 122 such that the bolt engagement projection 102 and the magazine biasing projection 109 of the bolt catch 100 are positioned above the lower bolt catch recess 122, within at least a portion of the lower receiver 120.

When installed in a lower bolt catch recess 122 of the lower receiver 120, as illustrated in FIGS. 20, 22, 24, 26-27, and 29, the bolt catch 100 is pivotable, relative to the lower receiver 120, via the bolt catch pivot pin 141 positioned through the bolt catch pivot pin aperture 106. The bolt catch 100 is pivotably attached or coupled to the lower receiver 120 on the left side, opposite the magazine release button. The bolt catch upper button portion 105 or the bolt catch lower button portion 107 can be pressed to pivot the bolt catch 100 about a bolt catch pivot pin aperture 106 to pivot the bolt catch 100 from a bolt engagement position to a bolt disengagement position.

The bolt catch 100 is typically spring biased to the bolt disengagement position, via a bolt catch plunger 145 and a bolt catch plunger spring 143 positioned within the bolt catch plunger recess 124.

In the bolt engagement position, the bolt catch 100 is pivoted such that at least a portion of a bolt engagement projection 102 extends in front of a portion of the face of the bolt carrier (when the bolt carrier is in a rearward position) and is able to engage a portion of the bolt face to maintain the bolt carrier in the rearward position. In the bolt disengagement position, the bolt catch 100 is pivoted such that the bolt engagement projection 102 will not engage the face of the bolt carrier and the bolt engagement projection 102 will not engage the bolt carrier.

The magazine biasing projection 109 extends from the bolt catch 100 so as to interact with a follower of an inserted magazine. In this manner, when an empty magazine is in the firearm, the magazine follower interacts with the magazine biasing projection 109, to pivot the bolt catch 100 to a bolt engagement position.

When the bolt catch upper button portion 105 is depressed, the bolt catch 100 pivots such that the bolt engagement projection 102 is urged downward, away from the face of the bolt carrier, allowing the bolt carrier to move forward. When the bolt catch lower button portion 107 is depressed, the bolt catch 100 pivots such that the bolt engagement projection 102 is urged upward, towards the face of the bolt carrier, prohibiting the bolt carrier to move forward and maintaining the bolt carrier in a rearward position.

The bolt catch 100 of the present disclosure includes additional material added proximate the bolt catch pivot pin aperture 106, which increases the amount of material within the bolt catch upper button portion recess 108. By increasing the amount of material proximate the bolt catch pivot pin aperture 106, the bolt catch 100 and the bolt catch upper button portion 105 are strengthened, when compared to a standard, known bolt catch 10. Because of the added material and relative size of the area of the bolt catch 100 proximate the bolt catch pivot pin aperture 106, the bolt catch 100 of the present disclosure will not fit within the area provided between a known upper receiver 30 and lower receiver 20.

To accommodate the improved, oversized the bolt catch plunger recess 124 has been moved further inward within the lower receiver 120, to accommodate the enlarged portions of the bolt catch 100 and allow the bolt catch plunger 145 and the bolt catch plunger spring 143 to provide a spring biasing force to the bolt catch 100 and allow the bolt catch 100 to rotate to the same number of degrees as a standard bolt catch 10. This has an added benefit of reducing the weight of the lower receiver 120.

The retaining lugs 129 of the lower receiver 120 are also enlarged to increase the strength of the lower receiver 120 proximate the lower bolt catch recess 122.

In order to accommodate the extra material added to the bolt catch 100, within the bolt catch upper button portion recess 108, an upper bolt catch recess 132 is formed in at least a portion of the upper receiver 130. The upper bolt catch recess 132 extends from a lower surface of the upper receiver 130. When the upper receiver 130 is operably attached or coupled to the lower receiver 120, the upper bolt catch recess 132 is positioned above the lower bolt catch recess 122.

Thus, when the bolt catch 100 is pivotably installed within the lower bolt catch recess 122, at least a portion of the bolt catch upper button portion recess 108 extends above a planar surface, SP, formed by the lower receiver 120, proximate each side of the lower bolt catch recess 122.

The upper bolt catch recess 132 allows at least a portion of the bolt catch 100, proximate the bolt catch upper button portion recess 108 to be received therein, allowing the bolt catch 100 to pivot between the bolt engagement position and the bolt disengagement position.

In various exemplary embodiments, at least one optional ridge or ridge segment 135 is formed so as to extend from at least a portion of the side wall of the upper receiver 130 around at least a portion of an area where the bolt catch upper button portion 105 of the bolt catch 100 overlies the upper receiver 130, when the bolt catch 100 is installed within the lower receiver 120 and the upper receiver 130 is operably attached or coupled to the lower receiver 120. In various exemplary embodiments, the ridge or ridge segment(s) 135 is/are a single, continuous ridge or ridge segment 135. Alternatively, the ridge or ridge segment(s) 135 may optionally be defined by one or more discrete ridge portions or segments.

When the bolt catch 100, lower receiver 120, and upper receiver 130 are in an operable configuration, the ridge or ridge segment(s) 135 do not contact the bolt catch 100, but provide a perimeter around at least a portion of the bolt catch 100 to reduce the likelihood that the bolt catch 100 will be inadvertently manipulated, to reduce the likelihood that the bolt catch upper button portion 105 will snag, and/or to aid in the proper placement of a user's finger on the bolt catch upper button portion 105 of the bolt catch 100. The ridge or ridge segment(s) 135 may include a textured portion (not shown), such that the ridge or ridge segment(s) 135 may be distinguished tactilely from other portions of the upper receiver 130 or the bolt catch upper button portion 105.

In various exemplary embodiments, a recess is defined within one or more portions of the optional ridge or ridge segment(s) 135.

In various exemplary, nonlimiting embodiments, the bolt catch upper button portion 105 includes a chamfered bolt catch button edge portion 115. The degree of chamfer and the extent of the chamfered bolt catch button edge portion 115 is a design choice. In various exemplary embodiments, the angle or degree of chamfer of the chamfered bolt catch button edge portion 115 is such that there is a substantially smooth transition between the chamfered bolt catch 100 button portion and an adjacent portion of the ridge or ridge segment(s) 135 of the upper receiver 130. In this manner, there is a substantially continuous surface flow between at least the chamfered bolt catch 100 button portion and the ridge or ridge segment(s) 135 of the upper receiver 130.

It should be appreciated that a more detailed explanation of the components of the upper receiver 130, lower receiver 120, and bolt catch 100, instructions regarding how to attach and use the various components of the upper receiver 130, lower receiver 120, and bolt catch 100, methods for installing the related components of the upper receiver 130, lower receiver 120, and bolt catch 100, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A bolt catch to be utilized in conjunction with an upper receiver and a lower receiver of a firearm, comprising:

a bolt catch having a bolt catch upper button portion and a bolt catch lower button portion, wherein said bolt catch is pivotally attached or coupled within at least a portion of a lower bolt catch recess of said lower receiver, approximately between said bolt catch upper button portion and said bolt catch lower button portion, wherein at least a portion of a bolt catch upper button portion recess extends above a planar surface formed by said lower receiver proximate said lower bolt catch recess; and an upper bolt catch recess formed in at least a portion of said upper receiver, wherein at least a portion of said bolt catch upper button portion recess is received at least partially within said upper bolt catch recess if said upper receiver is operably attached or coupled to said lower receiver.

2. The bolt catch of claim 1, wherein a first side of said bolt catch upper button portion includes a textured portion.

3. The bolt catch of claim 1, wherein a first side of said bolt catch lower button portion includes a textured portion.

4. The bolt catch of claim 1, wherein said bolt catch upper button portion recess is formed between said bolt catch upper button portion and a bolt engagement projection.

5. The bolt catch of claim 1, wherein said bolt catch upper button portion recess is formed between said bolt catch upper button portion and a magazine biasing projection.

6. The bolt catch of claim 1, wherein said bolt catch is pivotable between a bolt engagement position to a bolt disengagement position.

7. The bolt catch of claim 1, wherein a bolt catch pivot pin aperture is formed through said bolt catch, approximately between said bolt catch upper button portion and said bolt catch lower button portion.

8. The bolt catch of claim 1, wherein said upper bolt catch recess extends from a lower surface of said upper receiver.

9. The bolt catch of claim 1, wherein if said upper receiver is operably attached or coupled to said lower receiver, said upper bolt catch recess is positioned above said lower bolt catch recess.

10. The bolt catch of claim 1, wherein a ridge is formed so as to extend from at least a portion of said upper receiver around at least a portion of an area where said bolt catch upper button portion of said bolt catch overlies said upper receiver, when said bolt catch is installed within said lower receiver and said upper receiver is operably attached or coupled to said lower receiver.

11. The bolt catch of claim 10, wherein said ridge is a single, continuous ridge.

12. The bolt catch of claim 10, wherein said ridge is defined by one or more ridge portions are segments.

13. The bolt catch of claim 10, wherein said ridge provides a perimeter around at least a portion of said bolt catch.

14. The bolt catch of claim 10, wherein said bolt catch upper button portion includes a chamfered bolt catch button edge portion.

15. The bolt catch of claim 14, wherein an angle or degree of chamfer of said chamfered bolt catch button edge portion is such that there is a substantially smooth transition between said chamfered bolt catch button portion and an adjacent portion of said ridge.

16. A bolt catch to be utilized in conjunction with an upper receiver and a lower receiver of a firearm, comprising:

a bolt catch having a bolt catch upper button portion and a bolt catch lower button portion, wherein said bolt catch is pivotally positionable within at least a portion of a lower bolt catch recess of said lower receiver, wherein a bolt catch upper button portion recess is formed between said bolt catch upper button portion and a bolt engagement projection, and wherein at least a portion of said bolt catch upper button portion recess extends above a planar surface formed by said lower receiver proximate said lower bolt catch recess; and an upper bolt catch recess formed in at least a portion of said upper receiver, wherein at least a portion of said bolt catch upper button portion recess is received at least partially within said upper bolt catch recess if said upper receiver is operably attached or coupled to said lower receiver.

17. The bolt catch of claim 16, wherein said bolt catch is pivotable between a bolt engagement position to a bolt disengagement position.

18. The bolt catch of claim 16, wherein said upper bolt catch recess extends from a lower surface of said upper receiver.

19. The bolt catch of claim 16, wherein if said upper receiver is operably attached or coupled to said lower receiver, said upper bolt catch recess is positioned above said lower bolt catch recess.

20. A bolt catch to be utilized in conjunction with an upper receiver and a lower receiver of a firearm, comprising:

a bolt catch having a bolt catch upper button portion and a bolt catch lower button portion, wherein said bolt catch is pivotally positionable within at least a portion of a lower bolt catch recess of said lower receiver, wherein a bolt catch upper button portion recess is formed between said bolt catch upper button portion and a magazine biasing projection, and wherein at least a portion of said bolt catch upper button portion recess extends above a planar surface formed by said lower receiver proximate said lower bolt catch recess; and an upper bolt catch recess formed in at least a portion of said upper receiver, wherein at least a portion of said bolt catch upper button portion recess is received at least partially within said upper bolt catch recess if said upper receiver is operably attached or coupled to said lower receiver.

* * * * *